US009708939B2

(12) United States Patent
Kobayashi et al.

(10) Patent No.: US 9,708,939 B2
(45) Date of Patent: Jul. 18, 2017

(54) VALVE OPEN/CLOSE TIMING CONTROL DEVICE

(71) Applicant: AISIN SEIKI KABUSHIKI KAISHA, Kariya-shi, Aichi (JP)

(72) Inventors: Masaki Kobayashi, Okazaki (JP); Yoshiaki Yamakawa, Toyota (JP); Kazuo Ueda, Gamagori (JP)

(73) Assignee: AISIN SEIKI KABUSHIKI KAISHA, Kariya, Aichi (JP)

( * ) Notice: Subject to any disclaimer, the term of this patent is extended or adjusted under 35 U.S.C. 154(b) by 145 days.

(21) Appl. No.: 14/772,164

(22) PCT Filed: Oct. 8, 2014

(86) PCT No.: PCT/JP2014/076939
§ 371 (c)(1),
(2) Date: Sep. 2, 2015

(87) PCT Pub. No.: WO2015/056617
PCT Pub. Date: Apr. 23, 2015

(65) Prior Publication Data

US 2016/0298504 A1 Oct. 13, 2016

(30) Foreign Application Priority Data

Oct. 16, 2013 (JP) ..... 2013-215705

(51) Int. Cl.
*F01L 1/344* (2006.01)

(52) U.S. Cl.
CPC ..... *F01L 1/3442* (2013.01); *F01L 2001/3443* (2013.01); *F01L 2001/34433* (2013.01);
(Continued)

(58) Field of Classification Search
CPC ..... F01L 2001/34423; F01L 2001/3443; F01L 2001/34463
(Continued)

(56) References Cited

U.S. PATENT DOCUMENTS 6,257,207 B1 7/2001 Inui et al.
6,505,586 B1 1/2003 Sato et al.
(Continued)

FOREIGN PATENT DOCUMENTS

JP 2003-172109 A 6/2003
JP 2003-172110 A 6/2003
(Continued)

OTHER PUBLICATIONS

International Search Report (PCT/ISA/210) mailed on Jan. 6, 2015, by the Japanese Patent Office as the International Searching Authority for International Application No. PCT/JP2014/076939.
(Continued)

*Primary Examiner* — Jorge Leon, Jr.
(74) *Attorney, Agent, or Firm* — Buchanan Ingersoll & Rooney PC

(57) ABSTRACT

The valve open/close timing control device includes a housing that rotates synchronously with a crankshaft, an inner rotor that is disposed inside of the housing and rotates integrally with a camshaft, a fluid pressure chamber formed between the housing and the inner rotor, an intermediate lock mechanism capable of switching between a locked state and an unlocked state, an unlocking channel that allows passage of working oil to be supplied to or discharged from the intermediate lock mechanism, a lock discharge channel that allows passage of working oil discharged from the intermediate lock mechanism, and an electromagnetic valve that controls the supply/discharge of the working oil to/from the fluid pressure chamber and the intermediate lock mecha-
(Continued)

nism. With this valve open/close timing control device, the lock discharge channel allows passage of the working oil in the case where the electricity supply amount to the electromagnetic valve is 0 or the maximum.

3 Claims, 5 Drawing Sheets

(52) U.S. Cl.
CPC ..... *F01L 2001/34463* (2013.01); *F01L 2001/34466* (2013.01); *F01L 2001/34473* (2013.01); *F01L 2001/34479* (2013.01)

(58) Field of Classification Search
USPC ..... 123/90.15, 90.17
See application file for complete search history.

(56) References Cited

U.S. PATENT DOCUMENTS

| | | | | |
|---|---|---|---|---|
| 2003/0121486 | A1 | 7/2003 | Komazawa et al. | |
| 2005/0098130 | A1 | 5/2005 | Hirowatari et al. | |
| 2010/0050966 | A1* | 3/2010 | Ozawa ..... | F01L 1/3442 123/90.17 |
| 2010/0139593 | A1 | 6/2010 | Takemura | |
| 2010/0175651 | A1 | 7/2010 | Takenaka | |
| 2012/0186547 | A1 | 7/2012 | Fujiyoshi et al. | |
| 2013/0008397 | A1 | 1/2013 | Takada | |
| 2014/0041606 | A1 | 2/2014 | Kobayashi | |
| 2015/0114329 | A1 | 4/2015 | Kobayashi | |
| 2016/0108769 | A1 | 4/2016 | Kobayashi et al. | |
| 2016/0108770 | A1 | 4/2016 | Kobayashi et al. | |

FOREIGN PATENT DOCUMENTS

| | | | |
|---|---|---|---|
| JP | 2005-146922 | A | 6/2005 |
| JP | 2013-019282 | A | 1/2013 |
| WO | WO 2012/077220 | A1 | 6/2012 |

OTHER PUBLICATIONS

Written Opinion (PCT/ISA/237) mailed on Jan. 6, 2015, by the Japanese Patent Office as the International Searching Authority for International Application No. PCT/JP2014/076939.

International Search Report (PCT/ISA/210) mailed on Mar. 24, 2015, by the Japanese Patent Office as the International Searching Authority for International Application No. PCT/JP2014/084218.

Written Opinion (PCT/ISA/237) mailed on Mar. 24, 2015, by the Japanese Patent Office as the International Searching Authority for International Application No. PCT/JP2014/084218.

International Search Report (PCT/ISA/210) mailed on Feb. 10, 2015, by the Japanese Patent Office as the International Searching Authority for International Application No. PCT/JP2014/080245.

Written Opinion (PCT/ISA/237) mailed on Feb. 10, 2015, by the Japanese Patent Office as the International Searching Authority for International Application No. PCT/JP2014/080245.

* cited by examiner

| Electricity Supply amount | 0 ← | | | | → Maximum |
|---|---|---|---|---|---|
| Discharge channels | Drain | Close | | | Drain |
| Retarding channels | Drain | | Close | Supply | |
| Advancing channels | Supply | | Close | Drain | |
| Unlocking channels | Drain | Supply | | | Close |
| Position of spool | W1 | W2 | W3 | W4 | W5 |

VALVE OPEN/CLOSE TIMING CONTROL DEVICE

TECHNICAL FIELD

The present invention relates to a valve open/close timing control device that controls a relative rotation phase of a driven rotating body with respect to a driving rotating body that rotates synchronously with a crankshaft of an internal combustion engine.

BACKGROUND ART

In recent years, valve open/close timing control devices that make it possible to change the opening/closing timing of an intake valve and an exhaust valve in accordance with the operation status of an internal combustion engine (hereinafter referred to as an "engine" as well) have been put to practical use. These valve open/close timing control devices have a mechanism that, for example, by changing the relative rotation phase of the driven rotating body with respect to the rotation of the driving rotating body (hereinafter referred to as simply "relative rotation phase") by means of an engine operation, changes the opening/closing timing of an intake/exhaust valve that is opened and closed accompanying the rotation of the driven rotating body.

In general, the optimal opening/closing timing of the intake/exhaust valve differs according to the operation state of the engine, such as the state in which the engine is started, and the state in which the vehicle is traveling. By constraining the relative rotation phase to a predetermined phase between the maximum retard phase and the maximum advance phase when starting the engine, the opening/closing timing of the intake/exhaust valve that is optimal for starting the engine is realized, and a case in which a knocking sound is generated due to a partition of a fluid pressure chamber formed by the driving rotating body and the driven rotating body swinging is suppressed. For this reason, it is desired that the relative rotation phase is constrained to a predetermined phase before the engine is stopped.

PTL 1 discloses a valve open/close timing control apparatus that can lock the relative rotation phase in an intermediate lock phase based on an engine stop signal. In this valve open/close timing control apparatus, advancing control, retarding control, intermediate phase holding control, and lock control for locking in the intermediate lock phase are performed by one hydraulic control valve (electromagnetic valve). These controls are performed by changing the position of a spool in the hydraulic control valve according to an amount of electricity supplied to a solenoid. Specifically, (1) a case in which "total draining", "locking in an intermediate lock phase by means of an advancing action", "an advancing action in an unlocked state", "intermediate phase holding", and "a retarding action in an unlocked state" are controlled in the stated order, and (2) a case in which "a retarding action in an unlocked state", "intermediate phase holding", "an advancing action in an unlocked state", "locking in an intermediate lock phase by means of an advancing action", and "total draining" are controlled in the stated order, as the amount of electricity supplied to the solenoid increases from 0, are disclosed.

CITATION LIST

Patent Literature

PTL 1: JP 2003-172109A

SUMMARY OF INVENTION

Technical Problem

In the control of (1) and (2) above of the valve open/close timing control device disclosed in PTL 1, there is no state of "locking in an intermediate lock phase by means of a retarding action". For this reason, in order to perform locking in an intermediate lock phase with the relative rotation phase on the advance side of the intermediate lock phase, it has been necessary to perform locking using so-called loopback control in which control for "a retarding action in an unlocked state" is first performed so as to change the relative rotation phase to the retard side of the intermediate lock phase, and control for "locking in an intermediate lock phase by means of an advancing action" is switched to thereafter. For this reason, there has been a problem in that it takes a long time to achieve the locked state.

FIG. 21 of PTL 1 discloses a diagram showing an operation process of the hydraulic control valve, which is controlled such that "locking in an intermediate lock phase by means of a retarding action" is performed when the amount of electricity supplied to the solenoid is 0, and "locking in an intermediate lock phase by means of an advancing action" is performed when the amount of electricity supplied is the maximum. However, the operation process of the hydraulic control valve is merely illustrated in FIG. 21, and in paragraph [0067] of the specification in which FIG. 21 is described, there is no disclosure regarding the specific structure of the hydraulic control valve for realizing control of the operation process of the hydraulic control valve. Also, regarding the hydraulic control valves disclosed in the other embodiments, there is no disclosure at all of a structure according to which control for both "locking in an intermediate lock phase by means of a retarding action" and "locking in an intermediate lock phase by means of an advancing action" is possible, and thus it has not been possible for a person skilled in the art to conceive of such a structure based on the disclosure. Accordingly, a structure according to which control for both "locking in an intermediate lock phase by means of a retarding action" and "locking in an intermediate lock phase by means of an advancing action" are possible using one hydraulic control valve cannot be carried out based on PTL 1, and thus there has been room to make further improvements to the valve open/close timing control device in order to realize such a structure.

In view of the above-described problems, the present invention aims to provide a valve open/close timing control device according to which it is possible to perform control for both "locking in an intermediate lock phase by means of a retarding action" and "locking in an intermediate lock phase by means of an advancing action" using one electromagnetic valve.

Solution to Problem

In order to solve the above-described problem, a characteristic configuration of a valve open/close timing control device according to the present invention lies in including: a driving rotating body that rotates synchronously with a driving shaft of an internal combustion engine; a driven rotating body that is arranged inside of the driving rotating body, coaxially with an axis of the driving rotating body, and rotates integrally with a camshaft for opening/closing a valve of the internal combustion engine; a fluid pressure chamber defined between the driving rotating body and the driven rotating body; an intermediate lock mechanism capable of, with supply/discharge of a working fluid, selectively switching between a locked state in which a relative rotation phase of the driven rotating body with respect to the driving rotating body is constrained to an intermediate lock phase between a maximum advance phase and a maximum retard phase, and an unlocked state in which the constraint to the intermediate lock phase is released; an unlocking channel that allows passage of the working fluid to be supplied to or discharged from the intermediate lock mechanism; a lock discharge channel that does not allow passage of the working fluid to be supplied to the intermediate lock mechanism, but allows passage of the working fluid discharged from the intermediate lock mechanism to the outside; and an electromagnetic valve that is disposed inside of the driven rotating body, coaxially with the axis, and controls the supply and discharge of the working fluid to/from the fluid pressure chamber and the intermediate lock mechanism by changing an electricity supply amount, wherein if the electricity supply amount to the electromagnetic valve is 0 or the maximum, the lock discharge channel allows the passage of the working fluid such that the working fluid is discharged to the outside.

With this kind of characteristic configuration, passage of the working fluid is allowed so that the working fluid is discharged from the intermediate lock mechanism to the outside when the electricity supply amount is 0 or the maximum, and therefore the intermediate lock mechanism enters a lockable state. Also, for example, by configuring the electromagnetic valve such that advancing control is performed when the electricity supply amount is 0 and retarding control is performed when the electricity supply amount is the maximum, it is possible to reach the intermediate lock phase directly without performing loopback control as with the valve open/close timing control device disclosed in PTL 1, regardless of whether the relative rotation phase is on the retard side or the advance side of the intermediate lock phase. That is to say, it is possible to perform control for both "locking in an intermediate lock phase by means of a retarding action" and "locking in an intermediate lock phase by means of an advancing action". This makes it possible to realize the locked state in a short amount of time.

With the valve open/close timing control device of the present invention, it is preferable that if the electricity supply amount to the electromagnetic valve is 0, the unlocking channel allows the passage of the working fluid such that the working fluid is discharged to the outside.

With this kind of configuration, if the electricity supply amount is 0, a state is entered in which the passage of the working fluid is allowed in both the unlocking channel and the lock discharge channel so that the working fluid is discharged to the outside. Accordingly, the working fluid can be discharged from the intermediate lock mechanism in a shorter time compared to a conventional valve open/close timing control device including only an unlocking channel. For this reason, it is possible to reliably realize the locked state in the intermediate lock phase also by changing the relative rotation phase of the driven rotating body with respect to the driving rotating body in a short amount of time.

If the internal combustion engine stalls when the relative rotation phase of the driven rotating body with respect to the driving rotating body is in the retard direction with respect to the intermediate lock phase, the cam average torque will be generated such that the relative rotation phase is more in the retard direction. Due to this fact, the relative rotation phase changes in the retard direction to the vicinity of the maximum retard phase. Thus, if the internal combustion engine is re-started after being left alone in a state where the relative rotation phase is in the vicinity of the maximum retard phase, the locked state needs to be set by changing the relative rotation phase to the intermediate lock phase according to the cam variation torque, and in order to reliably set the locked state, the working fluid remaining in the intermediate lock mechanism needs to be discharged in a short amount of time. With the valve open/close timing control device according to the present invention, when the electricity supply amount is 0, the working fluid flows through both the unlocking channel and the lock discharge channel and is discharged to the outside. Therefore, the cross-sectional area of the discharge channel at a time of re-starting the internal combustion engine can be increased in comparison to that of the conventional structure, and the working fluid can be discharged in a short amount of time. This makes it possible to reliably realize the locked state in the intermediate lock phase when re-starting the internal combustion engine. In particular, if the internal combustion engine is re-started in a low temperature such as −20° C., the working fluid will be more viscous and thus more difficult to discharge. Therefore, the structure of the valve open/close timing control device of the present invention, according to which the cross-sectional area of the discharge channel can be increased when the electricity supply amount is 0 is particularly desirable.

With the valve open/close timing control device of the present invention, it is preferable that when operation of the internal combustion engine is stopped in a case where the electricity supply amount to the electromagnetic valve is the maximum and the intermediate lock mechanism is in the locked state, the electricity supply amount changes from the maximum to 0 after fluid pressure of the working fluid acting on the intermediate lock mechanism decreases to be less than or equal to a fluid pressure at which the unlocked state is not switched to.

If this kind of control is performed, it is possible to set the locked state by changing the relative rotation phase of the driven rotating body with respect to the driving rotating body to the intermediate lock phase before the operation of the internal combustion engine is stopped, and it is possible to keep the relative rotation phase at the intermediate lock phase without a switch to the unlocked state, even if the operation of the internal combustion engine is stopped thereafter. As a result, the internal combustion engine can be subsequently started in a state of being locked in the intermediate lock phase, which is a relative rotation phase that realizes the optimal opening/closing timing of the intake/exhaust valve, and the internal combustion engine can be started smoothly.

DESCRIPTION OF EMBODIMENTS

1. First Embodiment

Hereinafter, a first embodiment in which the present invention is applied to a valve open/close timing control device for an intake valve in an automobile engine (hereinafter simply referred to as an "engine") E will be described in detail with reference to the drawings. In the following description of the embodiment, the engine E is an example of an internal combustion engine.

[Overall Configuration]

Figure 1:
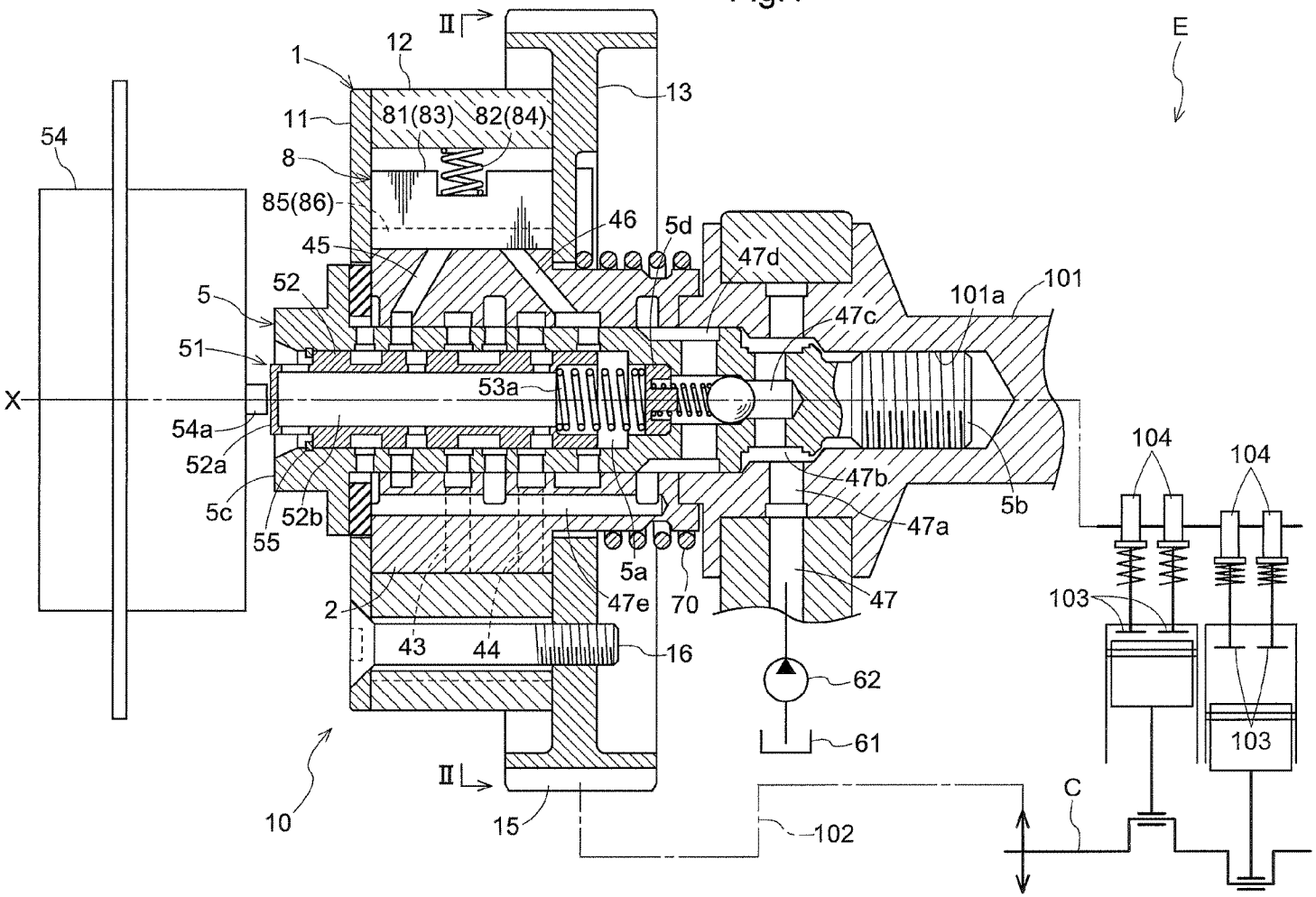
FIG. 1 is a vertical cross-sectional view showing a configuration of a valve open/close timing control device according to a first embodiment.

As shown in FIG. 1, a valve open/close timing control device 10 includes a housing 1 that rotates synchronously with a crankshaft C, and an inner rotor 2 that is disposed coaxially on axis X of the housing 1 inside of the housing 1 and rotates integrally with a camshaft 101 for opening/closing valves of the engine E. The camshaft 101 is a rotation shaft for cams 104, which control the opening/closing of intake valves 103 of the engine E, and rotates synchronously with the inner rotor 2 and a fixing bolt 5. The camshaft 101 is rotatably installed on a cylinder head of the engine E. Note that the crankshaft C is an example of a driving shaft, the housing 1 is an example of a driving rotating body, and the inner rotor 2 is an example of a driven rotating body.

A male screw 5*b* is formed on an end near the camshaft 101 of the fixing bolt 5. In a state in which the housing 1 and the inner rotor 2 are combined, the fixing bolt 5 is inserted into the middle and a male screw 5*b* of the fixing bolt 5 is screwed into a female screw 101*a* of the camshaft 101, and thereby the fixing bolt 5 is fixed to the camshaft 101 and the inner rotor 2 and the camshaft 101 are also fixed.

The housing 1 is constituted by installing, using a fastening bolt 16, a front plate 11 disposed on the side opposite to the side to which the camshaft 101 is connected, an outer rotor 12 fitted onto the inner rotor 2, and a rear plate 13 that integrally includes a timing sprocket 15 and is disposed on a side at which the camshaft 101 is connected. The inner rotor 2 is housed in the housing 1, and later-described fluid pressure chambers 4 are formed between the inner rotor 2 and the outer rotor 12. The inner rotor 2 and the outer rotor 12 are constituted so as to be able to rotate relative to each other about the axis X. Note that instead of the timing sprocket 15 being included in the rear plate 13, the timing sprocket 15 may be included in the outer circumferential portion of the outer rotor 12.

A return spring 70 that causes a biasing force to act in a direction of rotation centered about the axis X is included between the housing 1 and the camshaft 101. The return spring 70 has a function of causing a biasing force to act until the relative rotation phase of the inner rotor 2 with respect to the housing 1 (hereinafter simply referred to as the "relative rotation phase") reaches a predetermined relative rotation phase that is on the advance side from the maximum retard state, and not causing the biasing force to act in a range in which the relative rotation phase is on the advance side of the predetermined rotation phase. For example, a torsion spring or a spiral spring is used as the return spring 70. Note that the return spring 70 may be disposed between the housing 1 and the inner rotor 2.

Figures 2, 3:
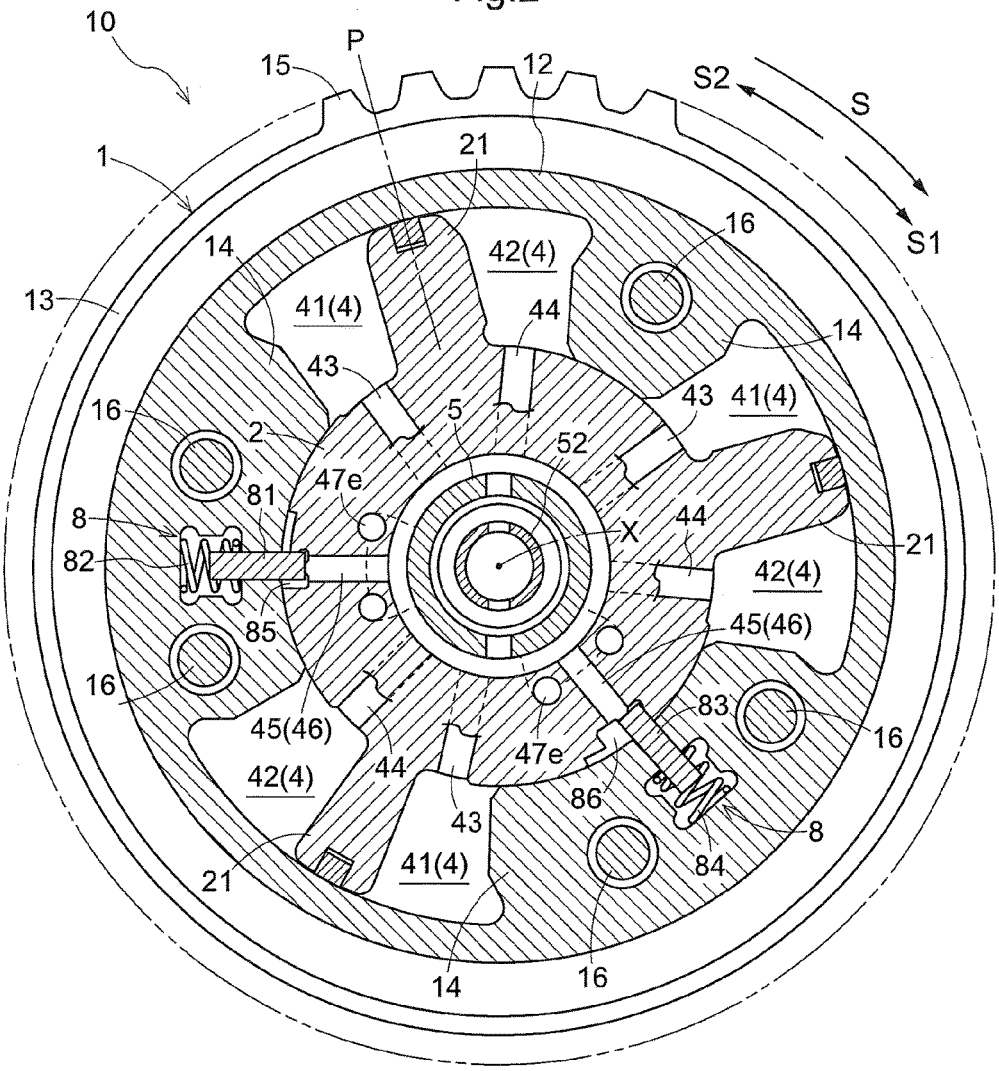
FIG. 2 is a cross-sectional view taken along line II-II in FIG. 1.
FIG. 3 is a diagram showing a state in which working oil flows through channels due to the action of an OCV.

When the crankshaft C is driven so as to rotate, the rotation driving force is transferred to the timing sprocket 15 via a power transfer member 102, and the housing 1 is driven so as to rotate in a rotation direction S shown in FIG. 2. Accompanying the rotation driving of the housing 1, the inner rotor 2 is driven so as to rotate in the rotation direction S so that the camshaft 101 rotates, and the cams 104 provided on the camshaft 101 press down the intake valves 103 of the engine E so as to open them.

As shown in FIG. 2, the fluid pressure chambers 4 are formed between the inner rotor 2 and the outer rotor 12 due to three protruding portions 14 that protrude inward in the radial direction and come into contact with the outer circumferential surface of the inner rotor 2 being formed apart from each other in the rotation direction S in the outer rotor 12. The protruding portions 14 also function as shoes on the outer circumferential surface of the inner rotor 2. Protruding portions 21 that come into contact with the inner circumferential surface of the outer rotor 12 are formed at portions on the outer circumferential surface of the inner rotor 2 which oppose the fluid pressure chambers 4. The fluid pressure chambers 4 are each divided into an advancing chamber 41 and a retarding chamber 42 by a protruding portion 21. Note that in the present embodiment, three fluid pressure chambers 4 are included, but there is no limitation to this.

Working oil (an example of working fluid) is supplied to or discharged from the advancing chambers 41 and the retarding chambers 42, or the supply/discharge thereof is blocked, and thereby the oil pressure of the working oil acts on the protruding portions 21, the relative rotation phase is changed in the advance direction or the retard direction using the oil pressure, or is held at a certain phase. The advance direction is a direction in which the volume of the advancing chambers 41 increases, and is the direction indicated by arrow S1 in FIG. 2. The retard direction is a direction in which the volume of the retarding chambers 42 increases, and is the direction indicated by arrow S2 in FIG. 2. The relative rotation phase when the protruding portions 21 have reached their moving ends (ends of swinging centered about the axis X) in the advance direction S1 is referred to as the maximum advance phase, and the relative rotation phase when the protruding portions 21 have reached their moving ends (ends of swinging centered about the axis X) in the retard direction S2 is referred to as the maximum retard phase. Note that the maximum advance phase is a concept that includes not only the moving ends in the advance direction S1 of the protruding portions 21, but also the vicinities thereof. Similarly, the maximum retard phase is a concept that includes not only the moving ends in the retard direction S2 of the protruding portions 21, but also the vicinities thereof.

As shown in FIG. 2, advancing channels 43 that are in communication with the advancing chambers 41, retarding channels 44 that are in communication with the retarding chambers 42, unlocking channels 45 through which working oil that is to be supplied to and discharged from a later-described intermediate lock mechanism 8 flows, and lock discharge channels 46 through which working oil to be discharged from the intermediate lock mechanisms 8 to the outside of the valve open/close timing control device 10 flows are formed in the inner rotor 2. As shown in FIG. 1, in the valve open/close timing control device 10, lubricating oil that is stored in an oil pan 61 of the engine E is used as the working oil, and the working oil is supplied to the advancing chambers 41, the retarding chambers 42, and the intermediate lock mechanism 8.

[Intermediate Lock Mechanism]

The valve open/close timing control device 10 includes an intermediate lock mechanism 8 that constrains the relative rotation phase of the inner rotor 2 with respect to the housing 1 to an intermediate lock phase P between the maximum advance phase and the maximum retard phase by constraining change in the relative rotation phase. Due to the relative rotation phase being constrained to the intermediate lock phase P in a state where the oil pressure of the working oil immediately after the engine start operation is not stable, the rotation phase of the camshaft 101 with respect to the rotation phase of the crankshaft C is maintained appropriately, and stable rotation of the engine E can be realized.

As shown in FIG. 2, the intermediate lock mechanism 8 is constituted by a first lock member 81, a first spring 82, a second lock member 83, a second spring 84, a first recessed portion 85, and a second recessed portion 86.

The first lock member 81 and the second lock member 83 are constituted by plate-shaped members, and are movably supported on the outer rotor 12 such that they can be brought toward and separated from the inner rotor 2 in an orientation parallel to the axis X. The first lock member 81 moves toward the inner rotor 2 due to the biasing force of the first spring 82, and the second lock member 83 moves toward the inner rotor 2 due to the biasing force of the second spring 84.

The first recessed portion 85 is defined in a groove shape along the direction of the axis X in the outer circumference of the inner rotor 2. The first recessed portion 85 is such that a shallow groove and a deep groove are formed continuously in the circumferential direction toward the retard direction S2. The groove width of the shallow groove is larger than the thickness of the first lock member 81, and the groove width of the deep groove is equivalent to that of the shallow groove and is larger than the thickness of the first lock member 81. The second recessed portion 86 is defined in a groove shape along the direction of the axis X in the outer circumference of the inner rotor 2. The second recessed portion 86 is such that a shallow groove and a deep groove are formed continuously in the circumferential direction toward the retard direction S2. The groove width of the shallow groove is about the same as the thickness of the second lock member 83, and the groove width of the deep groove is sufficiently larger than the thickness of the second lock member 83 and is larger than the groove width of the deep groove of the first recessed portion 85.

As shown in FIG. 2, with the intermediate lock phase P in a state in which there is no working oil in the first recessed portion 85 and the second recessed portion 86, after moving toward the inner rotor 2 due to the biasing force of the first spring 82, the first lock member 81 fits into the first recessed portion 85, and the first lock member 81 comes into contact with the end in the advance direction S1 of the deep groove of the first recessed portion 85 so as to restrict the inner rotor 2 from changing in the retard direction S2. Also, after moving toward the inner rotor 2 due to the biasing force of the second spring 84, the second lock member 83 fits into the second recessed portion 86 and the second lock member 83 comes into contact with the end in the retard direction S2 of the deep groove of the second recessed portion 86 so as to restrict the inner rotor 2 from changing in the advance direction S1. Thus, the relative rotation phase is constrained to the intermediate lock phase P by simultaneously restricting change in the advance direction S1 and the retard direction S2 of the inner rotor 2. This is the locked state.

The unlocking channels 45 are connected to the bottom surfaces of the deep groove of the first recessed portion 85 and the deep groove of the second recessed portion 86, and when the working oil flows through the unlocking channels 45 so as to be supplied to the first recessed portion 85 and the second recessed portion 86 in the locked state, the first lock member 81 and the second lock member 83 receive the oil pressure of the working oil. If the oil pressure exceeds the biasing force of the first spring 82 and the second spring 84, the first lock member 81 and the second lock member 83 separate from the first recessed portion 85 and the second recessed portion 86 respectively, and the unlocked state is entered. Also, the working oil, which is in the first recessed portion 85 and the second recessed portion 86 in the unlocked state, flows through the unlocking channels 45 and can be discharged to the outside of the valve open/close timing control device 10. Thus, the unlocking channels 45 allow passage of working fluid that is to be supplied to or discharged from the first recessed portion 85 and the second recessed portion 86.

The lock discharge channels 46 are also connected to the bottom surfaces of the deep groove of the first recessed portion 85 and the deep groove of the second recessed portion 86, but the lock discharge channels 46 do not allow passage of working oil that is to be supplied to the first recessed portion 85 and the second recessed portion 86, but allow passage of working oil that is to be discharged from the first recessed portion 85 and the second recessed portion 86 to the outside of the valve open/close timing control device 10.

[OCV]

As shown in FIG. 1, in the present embodiment, an OCV (oil control valve) 51 is disposed inside of the inner rotor 2, coaxially with the axis X. The OCV 51 is an example of an electromagnetic valve. The OCV 51 is configured to include a spool 52, a first spring 53*a* that biases the spool 52, and an electromagnetic solenoid 54 that drives the spool 52. Note that the electromagnetic solenoid 54 is a known technology, and therefore will not be described in detail here.

The spool 52 is accommodated in an accommodation space 5*a*, which is a hole with a circular cross-section that is formed in the direction of the axis X starting from a head portion 5*c*, which is the end that is further from the camshaft 101 of the fixing bolt 5, and the spool 52 can slide in the direction of the axis X inside of the accommodation space 5*a*. The spool 52 also has a main discharge channel 52*b*, which is a bottomed hole with a circular cross-section along the direction of the axis X. The inner diameter of the main discharge channel 52*b* is larger near the entrance than in the interior, and a level difference is formed therein.

The first spring 53*a* is provided deep inside of the accommodation space 5*a*, and normally biases the spool 52 in the direction of the electromagnetic solenoid 54 (the leftward direction in FIG. 1). The spool 52 is prevented from popping out of the accommodation space 5*a* by a stopper 55 attached to the accommodation space 5*a*. The level difference formed in the main discharge channel 52*b* holds one end of the first spring 53*a*. A partition 5*d* is inserted at the border between the accommodation space 5*a* and a second through hole 47*c*, which is a bottomed hole with a smaller inner diameter and is formed continuously with the accommodation space 5*a*. The partition 5*d* holds the other end of the first spring 53*a*. When electricity is supplied to the electromagnetic solenoid 54, a push pin 54*a* provided in the electromagnetic solenoid 54 presses the end 52*a* of the spool 52. As a result, the spool 52 slides in the direction of the camshaft 101 against the biasing force of the first spring 53*a*.

The OCV 51 is configured to be able to adjust the position of the spool 52 by changing the amount of electricity supplied to the electromagnetic solenoid 54 from 0 to the maximum. The amount of electricity supplied to the electromagnetic solenoid 54 is controlled by an ECU (electronic control unit) (not shown).

According to the position of the spool 52, the OCV 51 switches between the supply of working oil to the advancing chambers 41 and the retarding chambers 42, discharge thereof, and holding thereof, and performs switching between the supply of working oil to the intermediate lock mechanism 8 and the discharge thereof. FIG. 3 shows an active configuration of the OCV 51 when the position of the spool 52 is changed to W1 to W5 according to the amount of electricity supplied to the electromagnetic solenoid 54.

[Oil Channel Configuration]

As shown in FIG. 1, the working oil stored in the oil pan 61 is pumped by a mechanical oil pump 62 that is driven by the rotation driving force of the crankshaft C being transferred thereto, and the working oil flows through a later-described supply channel 47. Then, after flowing through the supply channel 47, the working oil is supplied to the advancing channels 43, the retarding channels 44, and the unlocking channels 45 via the OCV 51.

As shown in FIG. 1 and FIGS. 4 to 8, the advancing channels 43, which are connected to the advancing chambers 41, are each constituted by a first through hole 43*a* formed in the fixing bolt 5 and a second through hole 43*b* that is connected to the first through hole 43*a* and is formed in the inner rotor 2. The retarding channels 44, which are connected to the retarding chambers 42, are each constituted by a first through hole 44*a* formed in the fixing bolt 5, and a second through hole 44*b* that is connected to the first through hole 44*a* and is formed in the inner rotor 2. The unlocking channels 45, which are connected to the first recessed portion 85 and the second recessed portion 86, are each constituted by a first through hole 45*a* formed in the fixing bolt 5, and a second through hole 45*b* that is connected to the first through hole 45*a* and is formed in the inner rotor 2. The lock discharge channels 46, which are connected to the first recessed portion 85 and the second recessed portion 86, are each constituted by a first through hole 46*a* formed in the fixing bolt 5, and a second through hole 46*b* that is connected to the first through hole 46*a* and is formed in the inner rotor 2.

A supply channel 47 is constituted by a first through hole 47*a* formed in the camshaft 101, a first ring-shaped channel 47*b*, which is a space between the camshaft 101 and the fixing bolt 5, a second through hole 47*c* formed in the fixing bolt 5, a second ring-shaped channel 47*d* formed in the perimeter of the fixing bolt 5, a first channel 47*e* formed in the inner rotor 2, and third through holes 47*f* formed in the fixing bolt 5, and the channels are connected in the stated order.

The second through hole 47*c* is constituted by a bottomed hole formed in the fixing bolt 5 in the direction of the axis X, and multiple holes penetrating to the outer circumference at two different locations in the axis X direction in the bottomed hole. A check valve 48 is included in an intermediate portion of the bottomed hole, and the check valve 48 is biased in the direction of closing the bottomed hole of the second through hole 47*c* by a second spring 53*b*, which is held by the partition 5*d* and the check valve 48.

The first channel 47*e* is constituted by a channel that is formed in the fixing bolt 5 in the direction of the axis X and whose ends are closed, and three ring-shaped grooves formed inwardly in the radial direction from the channel to the inner circumferential surface at three different locations in the axis X direction. One of the three ring-shaped grooves opposes the second ring-shaped channel 47*d*, and the other two ring-shaped grooves oppose the third through holes 47*f*. In other words, the third through holes 47*f* are formed at two different locations along the direction of the axis X of the fixing bolt 5.

A first ring-shaped groove 52*c* and a second ring-shaped groove 52*d* that supply the working oil that flows through the supply channel 47 to one of the advancing channels 43, the retarding channels 44, and the unlocking channels 45 are formed in the spool 52. Furthermore, a first through hole 52*e* and a second through hole 52*f* that discharge the working oil that flows through the advancing channels 43, the retarding channels 44, the unlocking channels 45, and the lock discharge channels 46 to the main discharge channel 52*b* are formed in the spool 52. Furthermore, third through holes 52*g* that discharge the working oil that flows through the main discharge channel 52*b* to the outside of the valve open/close timing control device 10 are formed.

[Operation of OCV]

Figure 4:
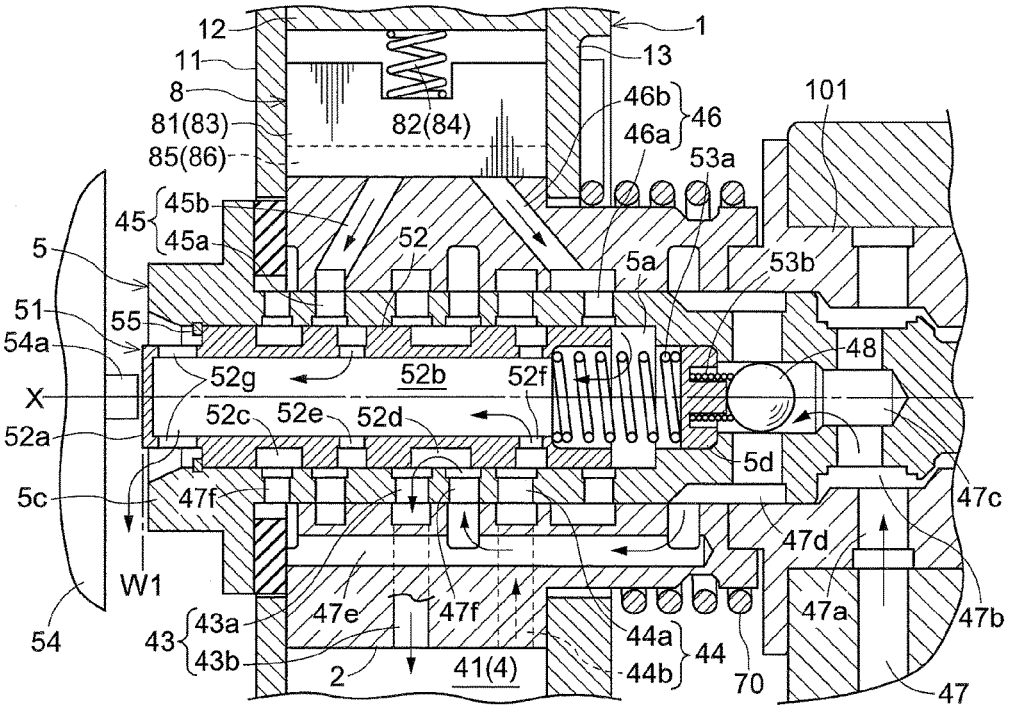
FIG. 4 is an enlarged cross-sectional view showing an active state of the OCV in W1.

As shown in FIG. 4, if electricity is not supplied to the electromagnetic solenoid 54 (electricity supply amount is 0), the OCV 51 is in the W1 state shown in FIG. 3, and the spool 52 is in contact with the stopper 55 and is located leftmost due to the biasing force of the first spring 53*a*. If the working oil is supplied to the supply channel 47 in this state, the working oil flows through the first through hole 47*a*, the first ring-shaped channel 47*b*, and the second through hole 47*c*. If the oil pressure acting on the check valve 48 exceeds the biasing force of the second spring 53*b* in the second through hole 47*c*, the check valve 48 opens. Then, the working oil flows through the second ring-shaped channel 47*d*, the first channel 47*e*, and the third through holes 47*f* so as to reach the first ring-shaped groove 52*c* and the second ring-shaped groove 52*d*. The first ring-shaped groove 52*c* is not connected to any of the channels, and thus no more working oil flows thereto. The second ring-shaped groove 52*d* is connected to the advancing channels 43, and therefore the working oil flows through the advancing channels 43 and is supplied to the advancing chambers 41. In other words, the advancing channels 43 are in a supply state. On the other hand, the retarding channels 44 are connected to the second through hole 52*f*, the unlocking channels 45 are connected to the first through hole 52*e*, and the lock discharge channels 46 are connected to the accommodation space 5*a*, which is connected to the main discharge channel 52*b*. For this reason, the working oil in the retarding chambers 42, the first recessed portion 85, and the second recessed portion 86 is discharged from the main discharge channel 52*b* to the outside of the valve open/close timing control device 10 through the third through holes 52*g*. In other words, the retarding channels 44, the unlocking channels 45, and the lock discharge channels 46 are all in the drain state.

If the OCV 51 is controlled so as to be in the W1 state when the protruding portions 21 are in the retard direction S2 with respect to the intermediate lock phase P, the inner rotor 2 changes in the advance direction S1, and when the relative rotation phase reaches the intermediate lock phase P, the first lock member 81 fits into the first recessed portion 85, the second lock member 83 fits into the second recessed portion 86, and the locked state is entered. This corresponds to "locking in an intermediate lock phase P by means of an advancing action". Note that cases in which "electricity is not supplied to the electromagnetic solenoid 54" include cases in which electricity is supplied to the electromagnetic solenoid 54 in a range in which the W1 state is maintained.

Figure 5:
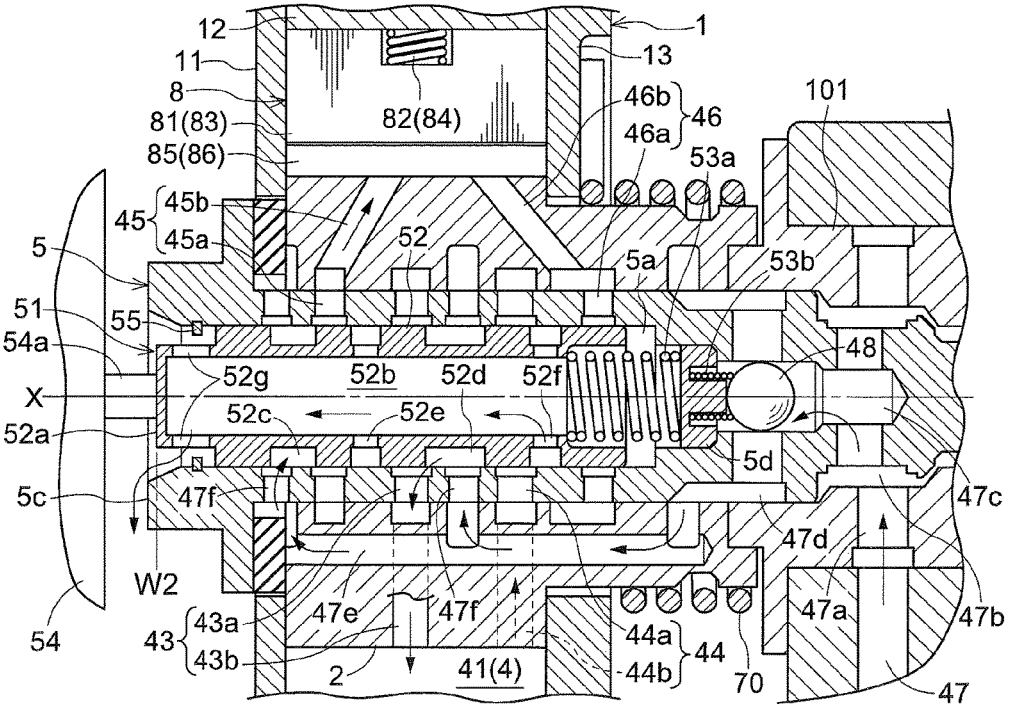
FIG. 5 is an enlarged cross-sectional view showing an active state of the OCV in W2.

As shown in FIG. 5, if electricity is supplied to the electromagnetic solenoid 54 so that the OCV 51 enters the W2 state shown in FIG. 3, the spool 52 moves slightly rightward from the W1 state. If the working oil is supplied to the supply channel 47 in this state, the working oil will reach the first ring-shaped groove 52*c* and the second ring-shaped groove 52*d*. Since the first ring-shaped groove 52*c* is connected to the unlocking channels 45, the working oil flows through the unlocking channels 45 and is supplied to the first recessed portion 85 and the second recessed portion 86. In other words, the unlocking channels 45 are in the supply state. At this time, the lock discharge channels 46 are not connected to the first through hole 52*e*, the second through hole 52*f*, or the accommodation space 5*a*, and thus a case does not occur in which the working oil flows through the lock discharge channels 46 to be discharged to the outside of the valve open/close timing control device 10. In other words, the lock discharge channels 46 are in the closed state. Accordingly, if the oil pressure of the working oil exceeds the biasing force of the first spring 82 and the second spring 84, the first lock member 81 and the second lock member 83 separate from the first recessed portion 85 and the second recessed portion 86 respectively, and the unlocked state is entered.

The second ring-shaped groove 52*d* is still connected to the advancing channels 43, and therefore the working oil flows through the advancing channels 43 and is supplied to the advancing chambers 41. In other words, the advancing channels 43 are in the supply state. On the other hand, since the retarding channels 44 are still connected to the second through hole 52*f*, the working oil in the retarding chambers 42 is discharged from the main discharge channel 52*b* to the outside of the valve open/close timing control device 10 through the third through holes 52*g*. In other words, the retarding channels 44 are in the drain state.

If the OCV 51 is controlled so as to be in the W2 state when the protruding portions 21 are in the retard direction S2 with respect to the intermediate lock phase P, the inner rotor 2 changes in the advance direction S1. At this time, the first recessed portion 85 and the second recessed portion 86 are filled with the working oil and are in the unlocked state, and therefore a case does not occur in which the locked state is entered even if the relative rotation phase reaches the intermediate lock phase P. This corresponds to "an advancing action in an unlocked state".

Figure 6:
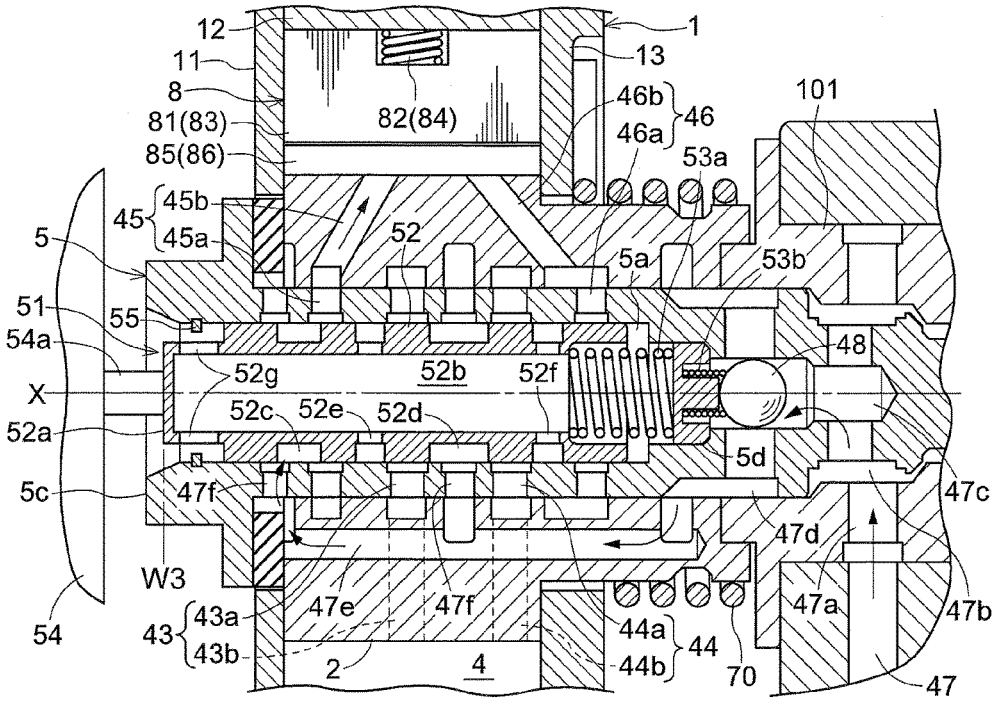
FIG. 6 is an enlarged cross-sectional view showing an active state of the OCV in W3.

As shown in FIG. 6, if electricity is further supplied to the electromagnetic solenoid 54 so that the OCV 51 enters the W3 state shown in FIG. 3, the spool 52 moves slightly rightward from the W2 state. If the working oil is supplied to the supply channel 47 in this state, the working oil will reach the first ring-shaped groove 52*c* and the second ring-shaped groove 52*d*. Since the first ring-shaped groove 52*c* is still connected to the unlocking channels 45, the working oil flows through the unlocking channels 45 and is supplied to the first recessed portion 85 and the second recessed portion 86. In other words, the unlocking channels 45 are in the supply state. At this time, similarly to the time of being in the W2 state, the lock discharge channels 46 are not connected to the first through hole 52*e*, the second through hole 52*f*, or the accommodation space 5*a*, and thus a case does not occur in which the working oil flows through the lock discharge channels 46 and is discharged to the outside of the valve open/close timing control device 10. In other words, the lock discharge channels 46 are in the closed state. Accordingly, if the oil pressure of the working oil exceeds the biasing force of the first spring 82 and the second spring 84, the first lock member 81 and the second lock member 83 separate from the first recessed portion 85 and the second recessed portion 86 respectively, and the unlocked state is entered.

The second ring-shaped groove 52*d* is not connected to any of the channels, and thus no more working oil flows thereto. In other words, the working oil is not supplied to the advancing channels 43 or the retarding channels 44. Also, the advancing channels 43 and the retarding channels 44 are not connected to the first through hole 52*e* or the second through hole 52*f*, and therefore a case does not occur in which the working oil in the advancing chambers 41 or the retarding chambers 42 is discharged to the outside of the valve open/close timing control device 10. Accordingly, since supply and discharge of the working oil to/from the advancing chambers 41 and the retarding chambers 42 is not performed when the OCV 51 is controlled so as to be in the W3 state, the inner rotor 2 is held at the relative rotation phase as it is and does not change in the advance direction S1 or the retard direction S2. In other words, the advancing channels 43 and the retarding channels 44 are in the closed state, which corresponds to "intermediate phase holding".

Figure 7:
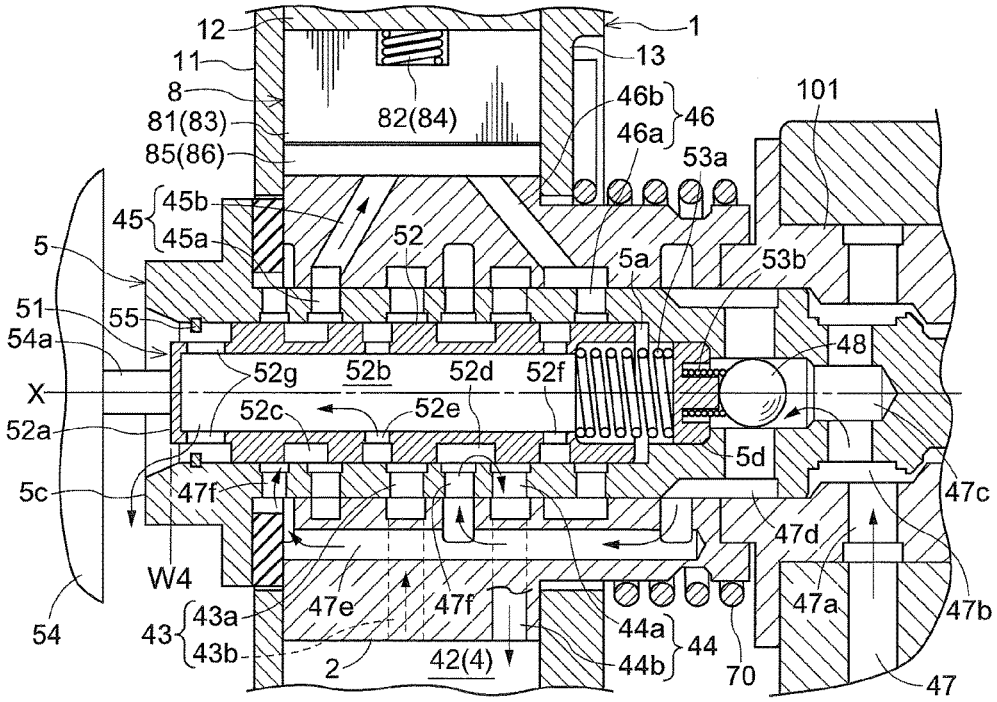
FIG. 7 is an enlarged cross-sectional view showing an active state of the OCV in W4.

As shown in FIG. 7, if electricity is further supplied to the electromagnetic solenoid 54 so that the OCV 51 enters the W4 state shown in FIG. 3, the spool 52 moves slightly rightward from the W3 state. If the working oil is supplied to the supply channel 47 in this state, the working oil will reach the first ring-shaped groove 52*c* and the second ring-shaped groove 52*d*. Since the first ring-shaped groove 52*c* is still connected to the unlocking channels 45, the working oil flows through the unlocking channels 45 and is supplied to the first recessed portion 85 and the second recessed portion 86. In other words, the unlocking channels 45 are in the supply state. At this time, similarly to the cases of W2 and W3, the lock discharge channels 46 are not connected to the first through hole 52*e*, the second through hole 52*f*, or the accommodation space 5*a*, and thus a case does not occur in which the working oil flows through the lock discharge channels 46 so as to be discharged to the outside of the valve open/close timing control device 10. In other words, the lock discharge channels 46 are in the closed state. Accordingly, if the oil pressure of the working oil exceeds the biasing force of the first spring 82 and the second spring 84, the first lock member 81 and the second lock member 83 separate from the first recessed portion 85 and the second recessed portion 86 respectively, and the unlocked state is entered.

The second ring-shaped groove 52*d* is connected to the retarding channels 44, and therefore the working oil flows through the retarding channels 44 and is supplied to the retarding chambers 42. In other words, the retarding channels 44 are in the supply state. On the other hand, since the advancing channels 43 are connected to the first through hole 52*e*, the working oil in the advancing chambers 41 is discharged from the main discharge channel 52*b* to the outside of the valve open/close timing control device 10 through the third through holes 52*g*. In other words, the advancing channels 43 are in the drain state.

If the OCV 51 is controlled so as to be in the W4 state when the protruding portions 21 are in the advance direction S1 with respect to the intermediate lock phase P, the inner rotor 2 changes in the retard direction S2. At this time, the first recessed portion 85 and the second recessed portion 86 are filled with the working oil and are in the unlocked state, and therefore a case does not occur in which the locked state is entered even if the relative rotation phase reaches the intermediate lock phase P. This corresponds to "a retarding action in an unlocked state".

Figure 8:
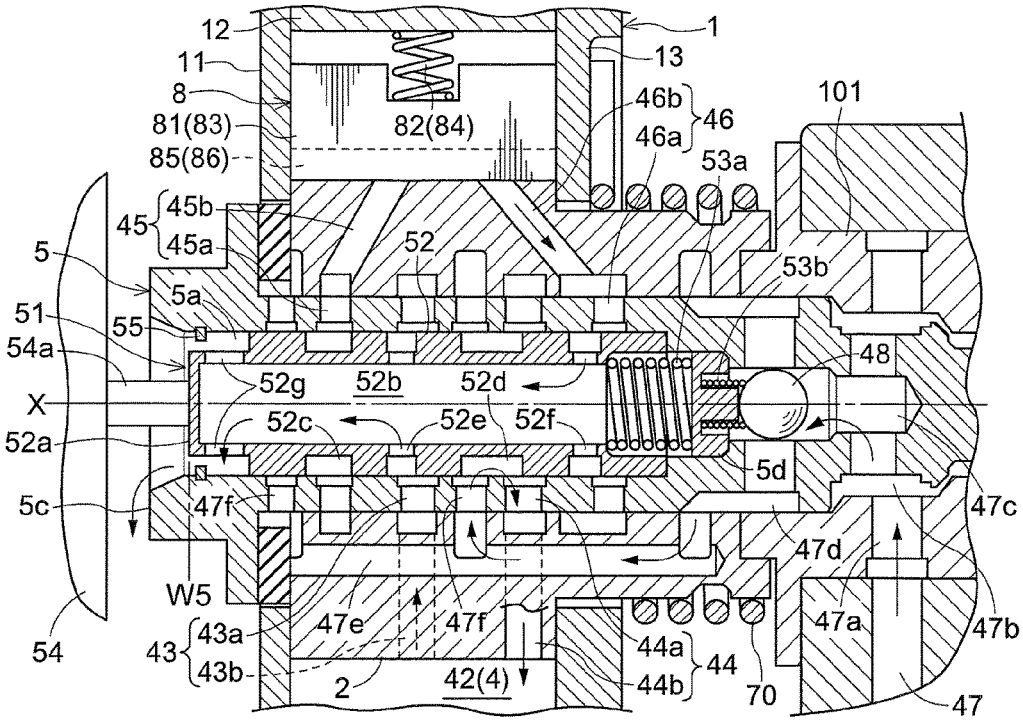
FIG. 8 is an enlarged cross-sectional view showing an active state of the OCV in W5.

As shown in FIG. 8, if the electricity supply amount to the electromagnetic solenoid 54 is increased to its maximum so that the OCV 51 enters the W5 state shown in FIG. 3, the spool 52 moves slightly rightward from the W4 state. If the working oil is supplied to the supply channel 47 in this state, the working oil will reach the second ring-shaped groove 52*d*, but since the first ring-shaped groove 52*c* is not connected to the third through holes 47*f*, the working oil will not reach the first ring-shaped groove 52*c*. The second ring-shaped groove 52*d* is still connected to the retarding channels 44, and therefore the working oil flows through the retarding channels 44 and is supplied to the retarding chambers 42. In other words, the retarding channels 44 are in the supply state. On the other hand, the advancing channels 43 are connected to the first through holes 52*e*, and the lock discharge channels 46 are connected to the second through hole 52*f*. For this reason, the working oil in the retarding chambers 42, the first recessed portion 85, and the second recessed portion 86 is discharged from the main discharge channel 52*b* to the outside of the valve open/close timing control device 10 through the third through holes 52*g*. In other words, the advancing channels 43 and the lock discharge channels 46 are both in the drain state. The lock discharge channels 45 are still connected to the first ring-shaped groove 52*c*, but as described above, since the first ring-shaped groove 52*c* is not connected to the third through holes 47*f*, no supply or discharge of the working oil is performed in the unlocking channels 45. In other words, the unlocking channels 45 are in the closed state. Note that since the lock discharge channels 46 are connected to the second through hole 52*f*, the working oil in the first recessed portion 85 and the second recessed portion 86 flows through the lock discharge channels 46 and is discharged to the outside of the valve open/close timing control device 10.

If the OCV 51 is controlled so as to be in the W5 state when the protruding portions 21 are in the advance direction S1 with respect to the intermediate lock phase P, the inner rotor 2 changes in the retard direction S2, and when the relative rotation phase reaches the intermediate lock phase P, the first lock member 81 fits into the first recessed portion 85 and the second lock member 83 fits into the second recessed portion 86, and the locked state is entered. This corresponds to "locking in an intermediate lock phase P by means of a retarding action". Note that cases in which "the amount of electricity supplied to the electromagnetic solenoid 54 is set to the maximum" include cases in which electricity is supplied with the electricity supply amount reduced from the maximum in a range in which the W5 state is maintained.

With the valve open/close timing control device 10 having the above-described configuration, it is possible to perform setting to a locked state in the intermediate lock phase P by changing the inner rotor 2 in the advance direction S1 when the protruding portions 21 are in the retard direction S2 with respect to the intermediate lock phase P, and it is possible to perform setting to a locked state in the intermediate lock phase P by changing the inner rotor 2 in the retard direction S2 when the protruding portions 21 are in the advance direction S1 with respect to the intermediate lock phase P. Accordingly, it is possible to realize the locked state in the intermediate lock phase P in a short time, regardless of the positions of the protruding portions 21.

In the present embodiment, both the unlocking channels 45 and the lock discharge channels 46 are connected to the bottom surfaces of the deep groove of the first recessed portion 85 and the deep groove of the second recessed portion 86. Also, in the W1 state, in which the electricity supply amount is 0, the working oil flows through both the unlocking channels 45 and the lock discharge channels 46 so as to be discharged to the outside of the valve open/close timing control apparatus 10, and therefore the working oil in the first recessed portion 85 and the second recessed portion 86 can be discharged in a shorter time compared to a conventional valve open/close timing control device 10 that includes only the unlocking channels 45. For this reason, it is possible to reliably realize the locked state in the intermediate lock phase P also by changing the relative rotation phase in a short amount of time.

If the engine E stalls when the protruding portions 21 are in the retard direction S2 with respect to the intermediate lock phase P, the cam average torque is generated such that the relative rotation phase moves in the retard direction S2. Due to this fact, the relative rotation phase changes in the retard direction S2 to the vicinity of the maximum retard phase. A case hardly ever occurs in which a change in the advance direction S1 is made and the intermediate lock phase P is reached. Thus, if the engine E is re-started after being left alone in a state where the relative rotation phase is near the maximum retard phase, the locked state needs to be set by changing the relative rotation phase to the intermediate lock phase P according to the cam variation torque, and in order to reliably set the locked state, the working oil remaining in the first recessed portion 85 and the second recessed portion 86 needs to be discharged in a short amount of time. With the valve open/close timing control device 10, when the electricity supply amount is 0, the working oil flows through the first recessed portion 85 and the second recessed portion 86 so as to be discharged to the outside, and therefore the cross-sectional area of the discharge channel at the time of re-starting the engine E can be made larger compared to that of the conventional structure, and the working oil can be discharged in a short amount of time. This makes it possible to reliably realize the locked state in the intermediate lock phase P when re-starting the engine E. In particular, if the engine E is re-started in a low temperature such as −20° C., the working oil will be more viscous and thus more difficult to discharge. Therefore, the structure of the valve open/close timing control device 10 according to which the cross-sectional area of the discharge channel can be increased when the electricity supply amount is 0 is particularly desirable.

In the present embodiment, if the ignition of the engine E is off when in the W5 state and the locked state in the intermediate lock phase P, the oil pressure of the working oil discharged from the oil pump 62 decreases and ultimately reaches 0. If the amount of electricity supplied to the electromagnetic solenoid 54 is set from the maximum to 0 at the same time as the ignition is turned off, the OCV 51 changes from the W5 state to the W1 state due to the biasing force of the first spring 53*a*. When in the W2, W3, and W4 states in the process of changing, the working oil is supplied to the first recessed portion 85 and the second recessed portion 86 through the unlocking channels 45, and therefore if the oil pressure of the working oil discharged from the oil pump 62 has not decreased sufficiently, there is a risk that oil pressure exceeding the biasing forces of the first spring 82 and the second spring 84 will act on the first lock member 81 and the second lock member 83 and the unlocked state will be entered.

In order to avoid entering the unlocked state unintentionally, it is desirable that the amount of electricity supplied to the electromagnetic solenoid 54 is set from the maximum to 0 not at the same time as the ignition is turned off, but after the oil pressure that will act on the first lock member 81 and the second lock member 83 has decreased to be less than or equal to the biasing force of the first spring 82 and the second spring 84. Performing this kind of control makes it possible to maintain the locked state before the ignition is turned off, even after the ignition has been turned off, and it makes it possible to subsequently start the engine E in a state of being locked in the intermediate lock phase P, which is the relative rotation phase according to which the optimal intake/exhaust valve opening/closing timing is realized. As a result, the engine E can be started smoothly. Note that it is possible to use any method, such as detecting the oil pressure of the working oil using an oil pressure sensor, the elapse of a predetermined amount of time after the ignition is turned off, and the like, in determining that the oil pressure acting on the first lock member 81 and the second lock member 83 has decreased to be less than or equal to the biasing forces of the first spring 82 and the second spring 84.

2. Modified Example of First Embodiment

Next, a modified example of the first embodiment will be described with reference to the drawings. In the present modified example, the configuration of the lock discharge channels 46 differs from the first embodiment, and the other configurations are the same. Accordingly, in the description of the present modified example, portions of the configuration that are the same as in the first embodiment are denoted by the same reference numerals, and description relating to similar configurations will not be repeated here.

Figure 9:
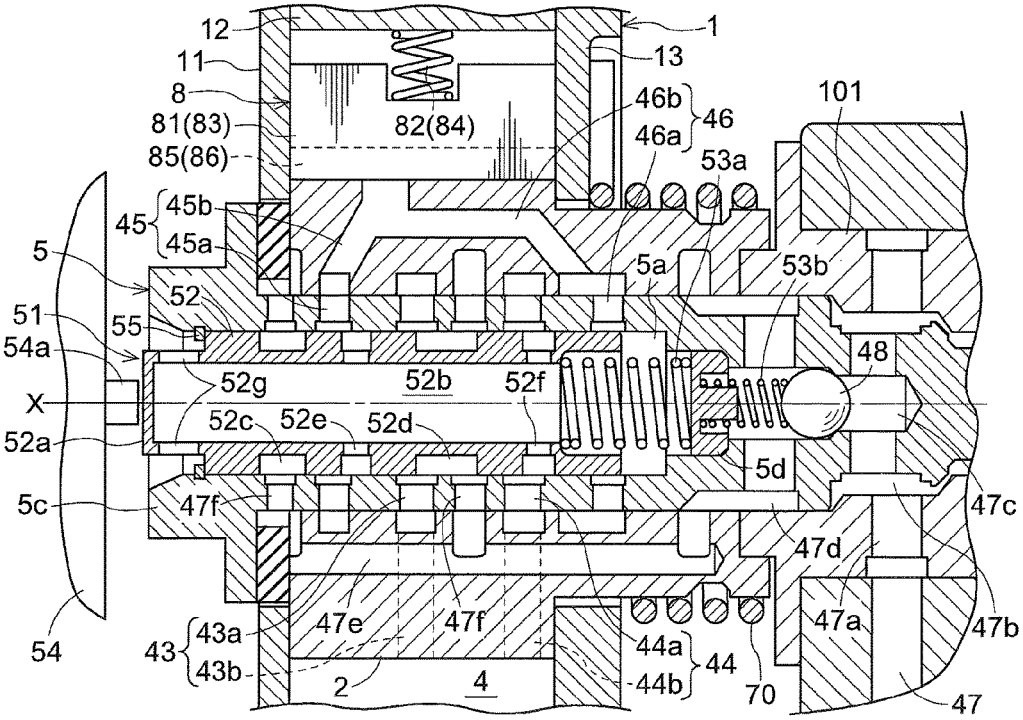
FIG. 9 is an enlarged cross-sectional view showing a configuration of a valve open/close timing control device according to a modified example of the first embodiment.

As shown in FIG. 9, in the valve open/close timing control device 10 according to the present modified example, the second through hole 46*b* of the lock discharge channels 46 is connected to the second through hole 45*b* of the unlocking channels 45, and is not connected to the first recessed portion 85 and the second recessed portion 86. With this kind of configuration as well, it is possible to obtain an effect similar to that of the valve open/close timing control device 10 of the first embodiment. In particular, the dischargeability of the working oil at the time of re-starting the engine E after a stall can also be made equivalent by expanding the cross-sectional area of the second through hole 45*b* from the location at which the second through hole 46*b* is connected to the first recessed portion 85 and the second recessed portion 86 to a value greater than or equal to the sum of the cross-sectional area of the second through hole 45*b* before being connected to the second through hole 46*b* and the cross-sectional area of the second through hole 46*b*.

In the above-described embodiment and modified example, if the electricity supply amount is 0, the advancing channels 43 are in the supply state, and the retarding channels 44, unlocking channels 45, and lock discharge channels 46 are in the drain state, but there is no limitation to this structure. By reversing the arrangement of the advancing channels 43 and the retarding channels 44, it is possible to obtain a structure in which the retarding channels 44 are in the supply state, and the advancing channels 43, unlocking channels 45, and the lock discharge channels 46 are in the drain state when the electricity supply amount is 0. By using this kind of configuration, when the electricity supply amount is 0, the working oil flows through both the first recessed portion 85 and the second recessed portion 86 and is discharged to the outside of the valve open/close timing control device 10 even if the engine E stalls when the protruding portions 21 are in the advance direction S1 with respect to the intermediate lock phase P. Therefore, the cross-sectional area of the discharge channels at the time of re-starting the engine E can be increased in comparison to that of the conventional structure, and the working oil can be discharged in a short amount of time.

In the above-described embodiment and modified example, the first lock member 81 and the second lock member 83 are both configured to move in the radial direction, but there is no limitation to this alone. The intermediate lock mechanism 8 may be configured such that the first lock member 81 and the second lock member 83 move in a direction along the axis X.

INDUSTRIAL APPLICABILITY

The present invention can be used in a valve open/close timing control device that controls a relative rotation phase of a driven rotating body with respect to a driving rotating body that rotates synchronously with a crankshaft of an internal combustion engine.

REFERENCE SIGNS LIST

1 Housing (driving rotating body)
2 Inner rotor (driven rotating body)
4 Fluid pressure chamber
8 Intermediate lock mechanism
10 Valve open/close timing control device
45 Unlocking channel
46 Lock discharge channel
51 OCV (electromagnetic valve)
101 Camshaft
C Crankshaft (driving shaft)
E Engine (internal combustion engine)
P Intermediate lock phase
X Axis

The invention claimed is:

1. A valve open/close timing control device, comprising:

a driving rotating body that rotates synchronously with a driving shaft of an internal combustion engine;

a driven rotating body that is arranged inside of the driving rotating body, coaxially with an axis of the driving rotating body, and rotates integrally with a camshaft for opening/closing a valve of the internal combustion engine;

a fluid pressure chamber defined between the driving rotating body and the driven rotating body;

an intermediate lock mechanism capable of, with supply/discharge of a working fluid, selectively switching between a locked state in which a relative rotation phase of the driven rotating body with respect to the driving rotating body is constrained to an intermediate lock phase between a maximum advance phase and a maximum retard phase, and an unlocked state in which the constraint to the intermediate lock phase is released;

an unlocking channel that allows passage of the working fluid to be supplied to or discharged from the intermediate lock mechanism;

a lock discharge channel that does not allow passage of the working fluid to be supplied to the intermediate lock mechanism, but allows passage of the working fluid discharged from the intermediate lock mechanism to the outside; and an electromagnetic valve that is disposed inside of the driven rotating body, coaxially with the axis, and controls the supply and discharge of the working fluid to/from the fluid pressure chamber and the intermediate lock mechanism by changing an electricity supply amount, wherein if the electricity supply amount to the electromagnetic valve is 0 or the maximum, the lock discharge channel allows the passage of the working fluid such that the working fluid is discharged to the outside.

2. The valve open/close timing control device according to claim 1, wherein if the electricity supply amount to the electromagnetic valve is 0, the unlocking channel allows the passage of the working fluid such that the working fluid is discharged to the outside.

3. The valve open/close timing control device according to claim 1, wherein when operation of the internal combustion engine is stopped in a case where the electricity supply amount to the electromagnetic valve is the maximum and the intermediate lock mechanism is in the locked state, the electricity supply amount changes from the maximum to 0 after fluid pressure of the working fluid acting on the intermediate lock mechanism decreases to be less than or equal to a fluid pressure at which the unlocked state is not switched to.

* * * * *